United States Patent [19]

Simonds et al.

[11] Patent Number: 4,693,228

[45] Date of Patent: Sep. 15, 1987

[54] CROSSBOW TRIGGER MECHANISM

[75] Inventors: Gary Simonds, Gainesville, Fla.; Thomas P. Jennings, Sun Valley, Calif.; Henry Gallops, Melrose, Fla.

[73] Assignee: Kidde Recreation Products, Inc., Gainsville, Fla.

[21] Appl. No.: 829,348

[22] Filed: Feb. 13, 1986

[51] Int. Cl.[4] ..... F41C 19/00

[52] U.S. Cl. ..... 124/25; 124/35 R; 124/40

[58] Field of Search ..... 124/35 R, 25, 31

[56] References Cited

U.S. PATENT DOCUMENTS

| | | | |
|---|---|---|---|
| 2,786,461 | 3/1957 | Pelsue | 124/25 |
| 3,490,429 | 1/1970 | Benedict | 124/25 |
| 3,538,901 | 11/1970 | Switack | 124/35 R |
| 4,030,473 | 6/1977 | Puryear | 124/25 |
| 4,192,281 | 3/1980 | King | 124/25 |
| 4,479,480 | 10/1984 | Holt | 124/35 R |

FOREIGN PATENT DOCUMENTS

| | | | |
|---|---|---|---|
| 1188583 | 6/1985 | Canada | 124/35 R |

*Primary Examiner*—Richard C. Pinkham
*Assistant Examiner*—Gary Jackson
*Attorney, Agent, or Firm*—Anthony A. O'Brien

[57] ABSTRACT

A crossbow includes a trigger mechanism providing positive setting or cocking and release of a drawn bowstring. As the bowstring is drawn, it is pulled rearwardly into a trigger assembly slot to momentarily rearwardly deflect and ride over a spring-urged string catch member. Deflection of the catch member in turn urges displacement of a safety element into locking engagement with a pivotal sear. A nose on the locked sear normally abuts the catch member to preclude its release of a bowstring cocked therebehind. Following manual displacement of the safety to an off position, squeezing of a trigger pivotally moves the sear nose clear of the catch member to permit the cocked bowstring to forwardly deflect and pass over the catch member as the bowstring leaves the trigger assembly and propels an arrow engaged thereby.

5 Claims, 4 Drawing Figures

CROSSBOW TRIGGER MECHANISM

BACKGROUND OF THE INVENTION

This invention relates generally to crossbows, and more particularly, to an improved retention and release mechanism for a drawn bowstring.

With the present arrangement, a unique structure is provided to allow a crossbow user to quickly and positively secure a drawn bowstring in the ready or cocked position without any separate manipulation of levers or catches being required before drawing of the crossbow. Prior crossbows are known wherein the user must initially set or cock a bowstring retaining member prior to drawing a bowstring and then insuring that the drawn string engages behind or beneath a catch member. Most usually, a metal to metal sear mechanism has been used and which, during shooting, relies upon one metal surface sliding across another metal surface. In view of the substantial pressure exerted between these two surfaces, the mating parts need be made of hardened steel to prevent rapid wear and in some cases wear has remained a problem, causing inconsistent trigger pressures and possible misfires. Many earlier devices lacked sufficient structure to provide positive, reliable safety means when handling the loaded crossbow.

By the present invention, a trigger assembly is provided comprising a self-contained housing within which all of the components are located to enable the simple and positive insertion, locking and retention of a drawn bowstring, together with an automatically actuated safety element which is placed in the safe position by the very insertion of the drawn bowstring. In this manner, following any drawing and cocking of the bowstring, the user subsequently manipulates the safety element to place it in the armed or off position prior to depressing a trigger serving to release the mechanism.

Accordingly, one of the objects of the present invention is to provide an improved bow trigger mechanism including a bowstring catch member normally disposed within the path of a guide slot and wherein insertion of the bowstring therein deflects the catch member as the bowstring passes thereover with the catch member thereafter returning to a vertical position within the guide slot and retaining the bowstring until a sear is displaced to release the catch member from its vertical position and allow the drawn bowstring to forwardly exit the guide slot.

A further object of the present invention is to provide an improved crossbow trigger mechanism including a housing having a guide slot for receiving a drawn bowstring whereupon insertion of a bowstring therein initially rearwardly deflects a string catch member while simultaneously displacing a safety element into a position locking a sear against any pivotal movement which could thereby produce a release of the catch member and bowstring.

Still another object of the present invention is to provide an improved crossbow trigger mechanism including a trigger assembly housing removably insertable within a bowstock and containing therein a pivotal string catch and safety member automatically displaced into one of two alternate positions by the insertion of a drawn bowstring into a guide throat of the housing.

With these and other objects in view, which will more readily appear as the nature of the invention is better understood, the invention consists of the novel construction, combination and arrangement of parts hereinafter more fully described, illustrated and claimed with reference being made to the attached drawing.

BRIEF DESCRIPTION OF THE DRAWING

FIG. 4 is a fragmentary view illustrating components of the trigger assembly housing as they appear with a bowstring in the loaded or cocked position and with the safety on.

Similar reference characters designate corresponding parts throughout the several figures of the drawing.

DESCRIPTION OF THE PREFERRED EMBODIMENT

Figure 1:
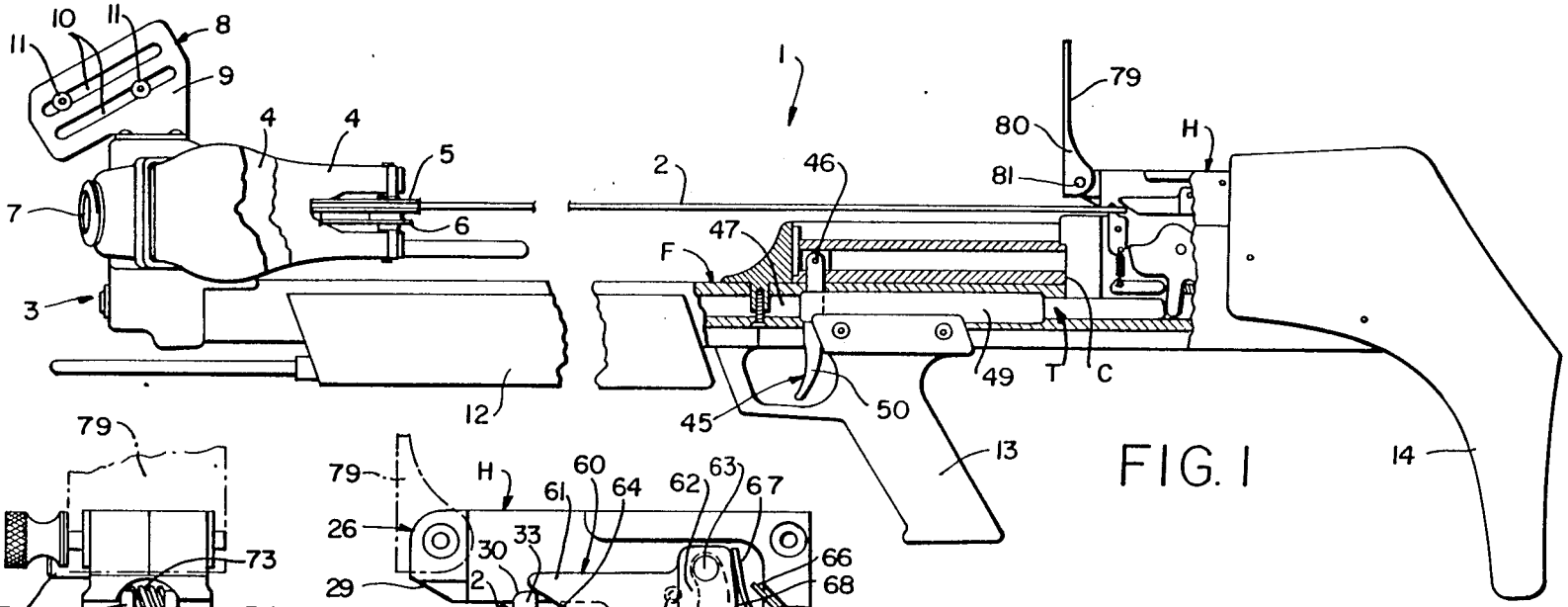
FIG. 1 is a side elevation of a crossbow employing the present invention.

Referring now to the drawing, particularly FIG. 1, this invention will be seen to relate to a crossbow, generally designated 1 and which includes, adjacent its forward end, suitable structure adapted to provide tension upon a bowstring 2, when drawn toward the rear of the crossbow. As this invention is primarily directed to the structure of a trigger mechanism, it will be appreciated that any of the various well-known assemblies may be affixed to the forward end 3 of the bow 1 to provide a tensioned bow string 2, such as the illustrated flexible bow limbs 4—4 having appropriate cams or eccentric pulleys 5,6 pivotally mounted at their ends in a manner similar to the well-known compound bows. This forwardly disposed structure may also include an arrow rest or forward arrow guide 7 as well as any well-known bowsight 8, such as the illustrated vertical plate 9 having a plurality of inclined slots 10, each adapted to removably and adjustably receive one or more sight bars or posts 10-11. The crossbow is shown as including a frame, generally designated F, which may include any appropriate construction such as the illustrated lightweight metallic channel construction extending substantially the majority of the length of the crossbow. Suitably removably affixed to this frame is a fore-stock 12, handgrip 13 and rearmost shoulder stock 14.

In use, a trigger assembly, generally designated T, serves to receive, retain, and selectively release a bolt or arrow A extending from the forward arrow rest 7 rearwardly to the bowstring 2 when the latter is drawn and engaged by the trigger mechanism. The relative position of nock 15 of the arrow as well as the bowstring 2, with respect to the structure of the trigger mechanism, is shown most clearly in FIG. 4 of the drawing.

Figure 2:
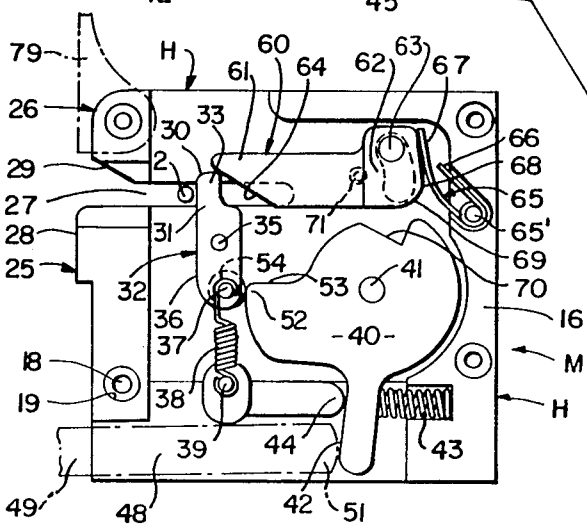
FIG. 2 is an enlarged side elevation illustrating the interior of the trigger assembly housing.

As will be seen most clearly in FIG. 2, the trigger assembly T includes a trigger mechanism M, comprising a housing H preferably formed with two laterally adjacent sections 16-17. In this manner the majority of moving components of the trigger assembly T are mounted within a single manipulatable housing H which may be handled as a separate unit selectively insertable in a cavity C formed in the crossbow frame. Any repair or replacement of the components of the trigger assembly housing H is readily accomplished simply by removing the housing from the crossbow frame and opening same by the subsequent removal of the housing section 17 from its cooperating section 16. This latter operation is accomplished by the removal of a plurality of screws 18, serving to join the two housing sections together through the juxtaposed bores 19.

As shown most clearly in FIG. 2 of the drawing, the housing H includes a lower body 25 having an upper arm 26 spaced thereabove to provide an arrow and bowstring guide throat or slot 27 extending rearwardly from the housing front wall 28 a substantial distance. This slot 27 fully extends horizontally through the housing and the forward portion of the upper arm 26 includes a tapered or inclined wall 29, serving to facilitate the insertion of the bowstring 2 into the slot. As a bowstring is drawn into the slot, either manually or by any of wellknown crossbow cocking devices, the nocking area of the bowstring strikes a shoulder 30 formed on a first end 31 of a bowstring nut or catch member 32. As will be seen most clearly in FIG. 3, this end of the catch member is bifurcated to provide a central slot 33 between two side portions 34-34 for reasons which will become obvious hereinafter. The catch member 32 is mounted for pivotal displacement about a medially disposed pivot pin 35 affixed to the housing section 16 while the second or lower end 36 of the catch member carries a pin 37 supporting one end of an extension spring 38. The opposite end of this spring is appropriately affixed to a pin 39 carried by the housing section 16 so that at all times the lower or second end 36 of the catch member is under the influence of this spring, and accordingly is constantly biased to a substantially vertical disposition urging the catch member shoulder 30 to the position as shown in FIG. 2 of the drawing.

Cooperating with the pivotally supported catch member 32, is a roller member or sear 40 comprising a plate element mounted for arcuate or pivotal displacement about a pivot pin 41 carried by the housing section 16. A portion 42 projects downwardly from the main body of the sear 40 to provide an actuating member arm, the operation of which will be described hereinafter. This arm 42 is constantly engaged by a sear compression spring 43 having one end stationary with respect to the housing section while its opposite end engages the sear arm 42, such that the sear 40 is continually urged in a clockwise direction about its pivot 41 with the limit of travel of the sear arm being defined by a stationary limit stop 44, offered by an appropriate abutment in the housing section 16.

The disposition of the various described elements as depicted in FIG. 2 of the drawing represents their relationship when the trigger assembly is either ready to receive the bowstring 2, or has just released the bowstring following actuation of an associated trigger. The trigger 45 as shown in FIG. 1 may be remotely located in the area of the handgrip 13 and includes an elongated element pivotally attached at its upper end to a stationary pivot 46 carried by the upper portion of the crossbow frame F. The medial portion of the trigger 45 passes through a horizontally extending bore or tunnel 47 extending along the lower portion of the corssbow frame and communicating with a recess 48 formed between the two lower portions of the housing sections 16-17. Disposed within this horizontal tunnel 47 is a trigger push rod or extension arm 49 loosely surrounding and engaging the trigger 45 intermediate its pivot 46 and lower finger portion 50 so that the rearmost portion 51 of the trigger extension arm 49 engages the trigger assembly sear actuating arm 42. In this manner, the force of the sear compression spring 43 not only normally urges the sear to the position of FIG. 2 but also normally maintains the trigger 45 urged to the position as shown in FIG. 1, which is the forwardmost limit of its movement. In this readied position, a forward curved surface on the sear 40 will be seen to engage and maintain the string catch member 32 in the illustrated vertical position. This referenced surface of the sear may be considered a sear nose 52, and is located immediately adjacent a cut-out or recessed portion 53 of the sear periphery. The contact between the sear nose 52 and string catch member 32 is preferably provided by a roller 54 pivotally carried by the second or lower end 36 of the catch member, so that a more friction-free engagement between the sear and catch member is provided. Re an alternative, the sear nose itself may comprise another roller (not shown) pivotally supported on the sear 40 and adapted normally to engage the catch member roller 54 in an off-center manner, above a line passing between the pins 37 and 41.

Before describing the sequence of operation of the various trigger mechanism components, one other important feature should be understood. This comprises safety means carried by the housing H and which is automatically actuated or placed in the safe or on position during the loading or attachment of the bowstring within the trigger assembly M. This safety means comprises a safety element, generally designated 60, which will be seen to include a generally horizontally disposed elongated member having a front section 61 and rear section 62 and which is mounted for pivotal displacement by means of a pivot pin 76 projecting inwardly from the housing section 16 to engage the medial portion of the safety element 60.

Figure 4:
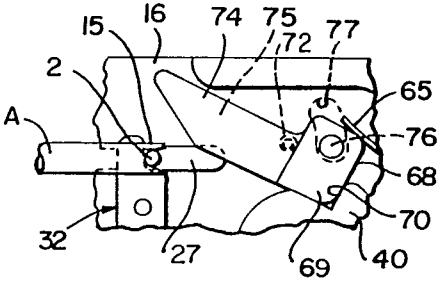

The safety element includes an inclined surface 64 extending downwardly and rearwardly from the forewardmost portion thereof to provide a cam surface normally within the path of the guide slot 27. It is important to note that the vertical extent of at least the front section 61 of the safety element is offset to one side of the center longitudinal axis as defined by a line passing between the side portions 34 of the string catch member 32. In other words, the safety element from section 61 is not within the path of an arrow nocking point as subsequently introduced through the string catch member slot 33, for reasons which will become obvious hereinafter. Safety element 60 is normally urged to one of two positions such as shown in FIGS. 2 and 4 by means of a double-acting torsion spring 65 which is anchored at a housing point or pin 65' and includes a relatively fixed end 66 and an opposite actuating end 67. The latter end constantly biases against the rear wall 68 of the safety element in an over center manner to retain the safety element in either of its alternate positions. This action is insured in view of the relative disposition of the spring anchor point 65' with respect to both the safety pivot 60 and the mass of the safety rear section 62. During stringing of the crossbow, the spring enforces a positive snapping of the safety member to the position of FIG. 4 whereupon a safety nose 69 thereon is urged downwardly into engagement within a recessed detent 70 formed in the periphery of the pivotal sear 40 thereby immobilizing the sear. The safety is considered to be on with this arrangement, and any attempt to depress the finger portion 50 of the trigger 45 is resisted since the sear and its actuating arm 42 are locked in a stationary position, thereby similarly immobilizing the trigger extension arm 49 and trigger 45.

Additional means may be included to indicate disposition of the safety element in the horizontal or off position as in FIG. 2 until such time as the safety is automatically or manually moved to the arcuately displaced, on position. This means comprises a fixed projection in the form of a ball bearing 71 having a portion of its surface projecting outwardly from the surrounding surface of the housing section 16. A mating detent or dimple 72, provided on the juxtaposed sidewall of the safety element receives the projection of the ball bearing 71 to additionally, temporarily retain the safety in the off position. To insure the foregoing biasing action, a compression spring 73 coiled about the safety element pivot pin 63 provides a constant urging apart between the housing section 17 and the left or first sidewall 74 of the safety element. In this matter it will be appreciated that the safety element will at all times be urged toward the housing section 16 and by selecting the strength of this compression spring 73 it is possible to determine the amount of force necessary to pivotally displace the safety element 60 from its off position to that of the on position. Although the ball bearing 71 is entirely optional, in view of the double-acting torsion spring 65, the compression spring 73 is utilized at all times since it maintains the sear element front section 61 to one side of the catch member central slot 33.

Figure 3:
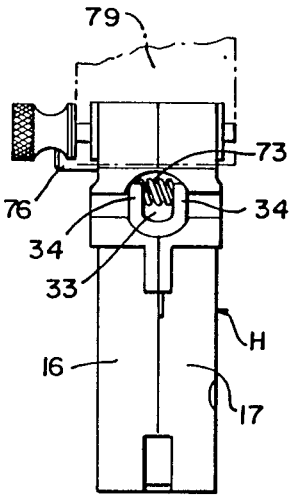
FIG. 3 is a front elevation of the trigger assembly housing.

As shown in FIG. 3 of the drawings, the thickness or lateral extent of the safety element front section 61 is substantially equal to that of one of the catch member side portions 34 located adjacent to housing section 16 and this side portion and safety element will be understood to be disposed in a substantially common vertical plane. This construction not only allows for the insertion of the nock 15 of an arrow A through the catch member slot 33 without interference from the safety element 60 but also provides for the automatic operation of the safety element 60 during cocking of the bow.

The operation of the trigger mechanism will now be related. Prior to drawing and cocking the bowstring 2, the apparatus will appear as in FIG. 2, wherein the sear nose 52 abuts the string catch member 32 and the sear actuating arm 42 is spring-urged to its forwardmost position along with the trigger finger portion 50. As the bowstring 2 is drawn rearwardly it is introduced into the guide throat 27 of the trigger assembly housing H, being guided thereinto with the assistance of the inclined wall 29 of the housing upper arm 26. Upon striking the catch member shoulder 30, continued rearward movement of the bowstring urges the catch member to be displaced in a clockwise manner until both side portions 34–34 are moved rearwardly and downwardly to a point adjacent the lower surface of the housing guide slot 27. At this point continued rearward movement causes the string to completely pass or ride over the catch member shoulder 30 and in view of the constant downward force being applied by the spring 38, the catch member will then be returned to a substantially vertical position. Concurrently with the rearward or clockwise displacement of the catch member 32, the safety element 60 will be understood to be likewise arcuately displaced about its pivot 33 in a clockwise manner as one of the catch member side portions 34 engages and cams the safety element surface 64 until it is fully within the confines of the housing upper arm 26. In this position the safety member nose 69 is seated within the sear safety detent 70 as shown in FIG. 4. Following the above clockwise displacement of the safety member, the over center spring 65 exerts force upon the safety to assist in retaining it in the safe position of FIG. 4. At this point, any continued rearward movement of the drawn bowstring 2 will be halted as the bowstring reaches the rearmost limit of the guide slot 27 and the rearward force being applied to the bowstring is then terminated. Quite obviously, the force developed by the crossbow limbs 4-4 is quite sufficient at this point since the crossbow may be considered to be at full draw and accordingly, the bowstring nocking area comes to rest as it strikes the rear of the catch member shoulder 30 since the opposite or lower end 36 of the catch member is held stationary in view of the engagement of its roller 54 against the sear nose 52. Accidental displacement of the safety from its on position of FIG. 4 is precluded in view of the downward force exerted by the arm 67 of the torsion spring 65.

The arrow A at this point can be placed into position on the crossbow by appropriately positioning its forward portion with respect to the arrow rest 7, and rearwardly inserting the arrow nock 15 within the catch member slot 33 until the nock envelops the nocking area of the bowstring 2 behind the catch member.

The crossbow 1 is now cocked and ready to be used. No release of the arrow is possible as long as the safety remains on as shown in FIG. 4 but when the user is ready to release the arrow, the safety is manually moved to the off position of FIG. 2 by actuating a knob 76 projecting outwardly from its second sidewall 75 and through a slot 77 in the adjacent housing section 16. When thusly actuated, rearward pressure upon the trigger finger portion 50 produces a counter-clockwise rotation of the sear 40 to clear its nose 52 from engagement with the catch member to roller 54 whereupon the force being applied to the bowstring by the limbs 4—4 drives the nocking area of the bowstring in a forward direction along with its attached arrow. During this latter action, the bowstring has displaced the catch member 32 shoulder 30 in a counter-clockwise direction until the bowstring passes over the top thereof after which the bowstring exits the housing guide throat 27. During the movement of the catch member shoulder 30 to a point adjacent the lower area of the guide throat 27, it will be understood that the lower portion 36 is unobstructed during its movement to the right, in view of the sear cut-out portion 53.

The trigger assembly housing H may also serve to support a rear sight 79. The depicted sight comprises a vertical apertured plate having a base 80 suitably pivotally attached to the housing upper arm 26 to allow for displacement between alternate use and non-use positions. In the illustration of FIG. 1, this sight 79 is shown in its elevated, use position and when not being used, the sight is merely displaced clockwise 90 degrees about pivot 81 until the body of the sight is flush with the top of the trigger assembly housing H.

Although the trigger mechanism is shown with a trigger 45 remotely located in the area of the forward handgrip 13, it will be appreciated that the sear 40 may be controlled directly from the area of the housing. This is readily accomplished by providing an extension on the actuating arm 42 such that this extension would, in effect, become the trigger.

We claim:

1. A crossbow having a frame provided with a bowstring attached to resilient limbs, a trigger mechanism for holding the bowstring in a drawn position and allowing the selective release thereof, characterized in that; said trigger mechanism including a trigger assembly attached to said frame rearwardly of said limbs and having forwardly opening bowstring guide means therein adapted to receive a drawn bowstring, a pivotal bowstring catch member provided with a shoulder normally disposed in a position within the path of said guide means, catch spring means urging said catch shoulder into said normally disposed position, a pivotal sear having means normally precluding forward displacement of said catch member shoulder within said guide means while allowing of free rearward displacement of said shoulder against the force of said catch spring means as said bowstring is rearwardly drawn into said guide means and rearwardly past said shoulder, a trigger operable to pivot said sear means and allow forward displacement of said catch member shoulder along with the forward release of said drawn bowstring from said guide means, an actuating arm on said sear, spring means engaging said sear to normally urge said sear means in position precluding said forward displacement of said catch member shoulder, and wherein said sear is provided with an external periphery and said sear means includes an outwardly projecting nose on said external periphery, and a pivotal roller on said catch member engageable with said sear nose.

2. A crossbow having a frame provided with a bowstring attached to resilient limbs, a trigger mechanism for holding the bowstring in a drawn position and allowing the selective release thereof, characterized in that; said trigger mechanism including a trigger assembly attached to said frame rearwardly of said limbs and having forwardly opening bowstring guide means therein adapted to receive a drawn bowstring, a pivotal bowstring catch member provided with a shoulder normally disposed in a position within the path of said guide means, catch spring means urging said catch shoulder into said normally disposed position, a pivotal sear having means normally precluding forward displacement of said catch member shoulder within said guide means while allowing of free rearward displacement of said shoulder against the force of said catch spring means as said bowstring is rearwardly drawn into said guide means and rearwardly past said shoulder, a trigger operable to pivot said sear means and allow forward displacement of said catch member shoulder along with the forward release of said drawn bowstring from said guide means, wherein said trigger assembly includes a housing having a lower body and an attached upper arm, and said guide means comprises a horizontal slot through said housing between said lower body and upper arm, and wherein said housing comprises two laterally adjacent sections, and said catch member and sear are carried by one said section.

3. A crossbow having a frame provided with a bowstring attached to resilient limbs, a trigger mechanism for holding the bowstring in a drawn position and allowing the selective release thereof, characterized in that; said trigger mechanism including a trigger assembly attached to said frame rearwardly of said limbs and having forwardly opening bowstring guide means therein adapted to receive a drawn bowstring, a pivotal bowstring catch member provided with a shoulder normally disposed in a position within the path of said guide means, catch spring means urging said catch shoulder into said normally disposed position, a pivotal sear having means normally precluding forward displacement of said catch member shoulder within said guide means while allowing of free rearward displacement of said shoulder against the force of said catch spring means as said bowstring is rearwardly drawn into said guide means and rearwardly past said shoulder, a trigger operable to pivot said sear means and allow forward displacement of said catch member shoulder along with the forward release of said drawn bowstring from said guide means, including a pivot pin mounting said catch member within said assembly between a first end containing said shoulder and an opposite second end, and said catch spring means engaging said second end to urge said shoulder into said normally disposed position within the path of said guide means, and further including a roller on said catch member second end engaging said sear means.

4. A crossbow having a frame provided with a bowstring attached to resilient limbs, a trigger mechanism for holding the bowstring in a drawn position and allowing the selective release thereof, characterized in that; said trigger mechanism including a trigger assembly attached to said frame rearwardly of said limbs and having forwardly opening bowstring guide means therein adapted to receive a drawn bowstring, a pivotal bowstring catch member provided with a shoulder normally disposed in a position within the path of said guide means, catch spring means urging said catch shoulder into said normally disposed position, a pivotal sear having means normally precluding forward displacement of said catch member shoulder within said guide means while allowing of free rearwardly displacement of said shoulder against the force of said catch spring means as said bowstring is rearwardly drawn into said guide means and rearwardly past said shoulder, a trigger operable to pivot said sear means and allow forward displacement of said catch member shoulder along with the forward release of said drawn bowstring from said guide means, safety means automatically initiated upon drawing of said bowstring past said catch shoulder whereby said safety means when initiated precludes said pivoting of said sear upon operation of said trigger, wherein said safety means includes a pivotally mounted safety element having a front section displaceable between alternate positions into and out of said guide means, and said catch member shoulder abutting and deflecting said safety front section upwardly and rearwardly upon said drawing of said bowstring past said catch shoulder, and wherein said safety element includes a rear section having a nose, and said sear is provided with a detent engageable by said safety nose when said safety front section is deflected upwardly.

5. A crossbow according to claim 4, including a knob laterally projecting from said safety element and manually operable to shift said safety element between said alternate positions.

* * * * *